US005220859A

United States Patent [19]

DeYoung

[11] Patent Number: 5,220,859

[45] Date of Patent: Jun. 22, 1993

[54] STRAND CARRIER FOR A BRAIDING MACHINE

[76] Inventor: Simon A. DeYoung, 5132 Mayview Rd., Lyndhurst, Ohio 44124

[21] Appl. No.: 878,774

[22] Filed: May 5, 1992

Related U.S. Application Data

[62] Division of Ser. No. 563,538, Aug. 6, 1990, Pat. No. 5,146,836.

[51] Int. Cl.[5] ..... D04C 3/18

[52] U.S. Cl. ..... 87/57; 87/22; 403/322; 403/328

[58] Field of Search ..... 87/20, 21, 22, 54, 55, 87/56, 57, 61, 62; 403/322, 324, 328

[56] References Cited

U.S. PATENT DOCUMENTS

| | | | |
|---|---|---|---|
| 1,123,840 | 1/1915 | Bronson | 403/322 X |
| 2,619,001 | 11/1952 | Chace | 87/22 |
| 3,359,848 | 12/1967 | Ostermann | 87/56 |
| 3,396,625 | 8/1968 | Faulkner | 87/57 |
| 3,425,315 | 2/1969 | Kaufmann | 87/57 |
| 3,794,265 | 2/1974 | Jantzen | 403/324 X |
| 3,817,147 | 6/1974 | Richardson | 87/57 |
| 3,882,757 | 5/1975 | Weatherby | 87/57 |
| 4,529,147 | 7/1985 | Bull et al. | 242/156.2 |
| 4,719,838 | 1/1988 | DeYoung | 87/57 |

*Primary Examiner*—Joseph J. Hail, III

*Attorney, Agent, or Firm*—Body, Vickers & Daniels

[57] ABSTRACT

The tension head of a strand carrier for a braiding machine comprises coaxial head members, the first of which is fixed and the second of which is axially displaceable toward the first member, and a plurality of tension spring cartridges therebetween biasing the second head member away from the first head member. The carrier further includes a bobbin and strand guide components coaxial with the tension head, and the tension head further includes a clutch arrangement including a clutch plate interposed between the bobbin and the second head member of the tension head, and a plurality of clutch spring units interposed between the first head member of the tension head and the clutch plate to bias the latter toward the bobbin. The tension head, bobbin and strand guide components are releasably mounted on a support shaft of the carrier by a latch arrangement between the shaft and first head member of the tension head.

5 Claims, 5 Drawing Sheets

STRAND CARRIER FOR A BRAIDING MACHINE

This is a division of application Ser. No. 563,538, filed Aug. 6, 1990, now U.S. Pat. No. 5,146,836.

BACKGROUND OF THE INVENTION

The present invention relates to the art of braiding machines and, more particularly, to improvements in a strand carrier for carrying and controllably releasing a strand in a braiding machine.

Braiding machines are of course well known and are used, for example, to braid metallic wire into electrical or electronic cable as a protective armor, or into hydraulic hose and cordage as a load bearing structure, or into metallic or non-metallic rope. The present invention relates to improvements in a strand carrier for such machines and, in particular, to a strand carrier of the type having coaxial base, bobbin, strand guide and tension head components, such as the carrier illustrated and described in my U.S. Pat. No. 4,719,838, the disclosure of which is incorporated herein by reference.

In a carrier of the foregoing character, the tension head is comprised of an axially fixed member and an axially movable member spring biased away from the fixed member. Each of the head members has an arrangement of strand pulleys which guide the strand between the member such that tension applied to the strand urges the axially movable member toward the axially fixed member against the bias of the springs between the members. Further in connection with such a tension head, a clutch plate is interposed between the movable member and bobbin and is biased toward the bobbin by clutch spring units between the clutch plate and the fixed member of the tension head. When the tension applied to the strand urges the axially movable member toward the axially fixed member, the clutch spring units are displaced by the movable member to release the clutch plate from the bobbin freeing the latter to rotate relative to the strand guide and tension head allowing strand to play from the bobbin.

In the tension head disclosed in my aforementioned patent, the tension controlling springs are captured between the fixed and movable members by having their opposite ends received in corresponding spring pockets in the two members. Further, the clutch spring units include spring supporting members secured to the clutch plate and extending through openings therefor in the movable member toward the fixed member, and the clutch springs are axially captured between the spring supports and fixed member of the head by having their opposite ends received in corresponding spring pockets in the supports and fixed member. The fixed and movable head members with the tension controlling springs and clutch springs compressed therebetween are mounted on a sleeve member together with the clutch plate to provide the tension head. The clutch plate is axially retained at one end of the sleeve by a split ring, and the fixed member is pinned to the sleeve adjacent the opposite end thereof to maintain the component parts against axial separation. The bobbin and tension head are mounted on the shaft portion of the base together with the strand guide holder, and these component parts are secured to the shaft against axial separation by an end cap member bolted to the shaft and engaging the axially outer end of the fixed member of the tension head assembly.

To disassemble the major parts of the carrier, the end cap is removed to free the tension head, bobbin and strand guide holder for removal from the shaft. Disassembly of the tension head for repair or replacement of the component parts thereof requires removal of the pins engaging the fixed member with the sleeve against axial separation therefrom. Removal of the latter pins releases the movable member for axial separation from the sleeve, and this operation is both cumbersome and hazardous to the person disassembling the tension head as well as to other persons or objects in the vicinity of the disassembly work. In this respect, tension controlling springs generally have an uncompressed length of twenty or more inches, a compressed length of about four inches, and a force when compressed of from ten to forth pounds. Accordingly, when the movable head member is released for axial separation from the supporting sleeve, extreme care must be exercised to avoid unintended release or lateral displacement of the movable member relative to the spring axes during decompression of the springs. Otherwise, the head member and/or springs become projectiles which can seriously injure the worker or other persons in the vicinity thereof. Moreover, the head member and/or springs can impact with other equipment in the area damaging the latter as well as the head member and springs. Even though a worker may be able to hold onto the movable head member, the spring soften become dislodged prior to full decompression thereof and are propelled by their own resiliency from their positions between the fixed and movable head member.

Further problems are incurred in connection with assembling or reassembling the components parts of the tension head. In this respect, it will be appreciated that it is extremely difficult to maintain proper alignment between a plurality of compression springs having a length of twenty or more inches while the springs are displaced by moving the fixed member of the tension head assembly towards the movable member and to the assembled relationship therewith in which the compression springs have been compressed to a length of about four inches. Again, a hazardous situation is presented in that the compression springs can become dislodged from between the two members of the tension head, thus exposing the worker to potential injury. Thus, the assembly operation too is both tedious and potentially hazardous. Moreover , the potential for injury adds to the anxiety of the worker during both assembly and disassembly operations. Adding further to such tediousness and anxiety is the fact that the insertion and removal of the pins holding the fixed member to the sleeve component of the tension head requires holding the fixed member against the spring force with one hand while manipulating the pins with the other hand such as through the use of pliers, and working with the latter in the area occupied by the hand holding the fixed member against the spring force.

In addition to the foregoing problems, even if just one of the tension controlling springs or one of the clutch springs needs to be replaced, the foregoing disassembly and reassembly operations are necessary to do so.

SUMMARY OF THE INVENTION

In accordance with the present invention, an improved tension controlling spring arrangement is provided by which the foregoing and other problems attendant to the assembly and disassembly of the component parts of the tension head are overcome. More particularly in this respect, tension controlling spring cartridges are provided between the fixed and movable members of the tension head, each of which cartridges includes a support and a corresponding tension controlling spring in a precompressed condition on the support for assembly or disassembly relative to the fixed and movable head members. Preferably, the spring cartridge units are releasably mounted between the fixed and movable head members by means of a cartridge retaining plate accessible for removal from the axially outer end of the fixed member. This advantageously enables the cartridge units to be disassembled relative to the tension head for replacement without removing the tension head from the support shaft. Further, removal of the spring cartridges enables the expeditious and safe assembly, disassembly and reassembly of the component parts of the tension head unit by avoiding release of the compression springs to their uncompressed length. Preferably, the precompressed length of the tension controlling spring on its support is slightly greater than the compressed length when the cartridge is assembled on the tension head. This relationship advantageously biases the retaining plate against unintentional release of the spring cartridges and precludes any undesirable free play with respect to relative axial movement between the fixed and movable members of the tension head.

In accordance with another aspect of the invention, the clutch spring elements are mounted between the fixed member of the tension head and the corresponding clutch spring support member so as to be accessible from the axially outer end of the fixed head member for removal. This advantageously enables a clutch spring to be removed and replaced without having to remove the tension head from the support shaft and without having to disassemble the component parts of the tension head. The clutch spring feature, together with removability of the tension controlling spring cartridges, provides for disassembly and reassembly of the component parts of the tension head without any interference resulting from having to align and compress either the tension or clutch springs.

In accordance with yet another aspect of the invention, the tension head, bobbin and strand guide holder of a strand carrier are releasably mounted on the support shaft of the base by a latch arrangement between the shaft and tension head. This further promotes the ease of assembly and disassembly of the component parts of the carrier relative to the support shaft for maintenance or replacement.

It is accordingly an outstanding object of the present invention to provide an improved tension controller spring arrangement between relatively displaceable members of a tension head in a strand carrier for a braiding machine.

Another object is to provide a tension controlling spring arrangement of the foregoing character which promotes ease and safety in connection with the assembly and disassembly of the components parts of the tension head of a strand carrier.

A further object is the provision of a tension controlling spring arrangement of the foregoing character which provides for the removal and replacement of tension controlling springs from the tension head without disassembly of the other component parts of the tension head.

Still another object is the provision of a tension head for a strand carrier with removably mounted precompressed tension springs cartridges operable to maintain strand tension during operation of a braiding machine.

Yet a further object is the provision of a tension head for a strand carrier with clutch springs readily accessible and removable from the tension head without disassembly of the other component parts thereof.

Another object is the provision of an improved mounting arrangement for tension head, bobbin and strand guide components of a strand carrier in a braiding machine which enable the assembly and disassembly of the component parts of the carrier to be readily achieved with more efficiency and with less effort than heretofore possible.

BRIEF DESCRIPTION OF THE DRAWINGS

The foregoing and other objects of the present invention will in part be obvious and in part pointed out more fully hereinafter in connection with the written description of preferred embodiments illustrated in the accompanying drawings in which.

DESCRIPTION OF PREFERRED EMBODIMENTS

Figure 1:
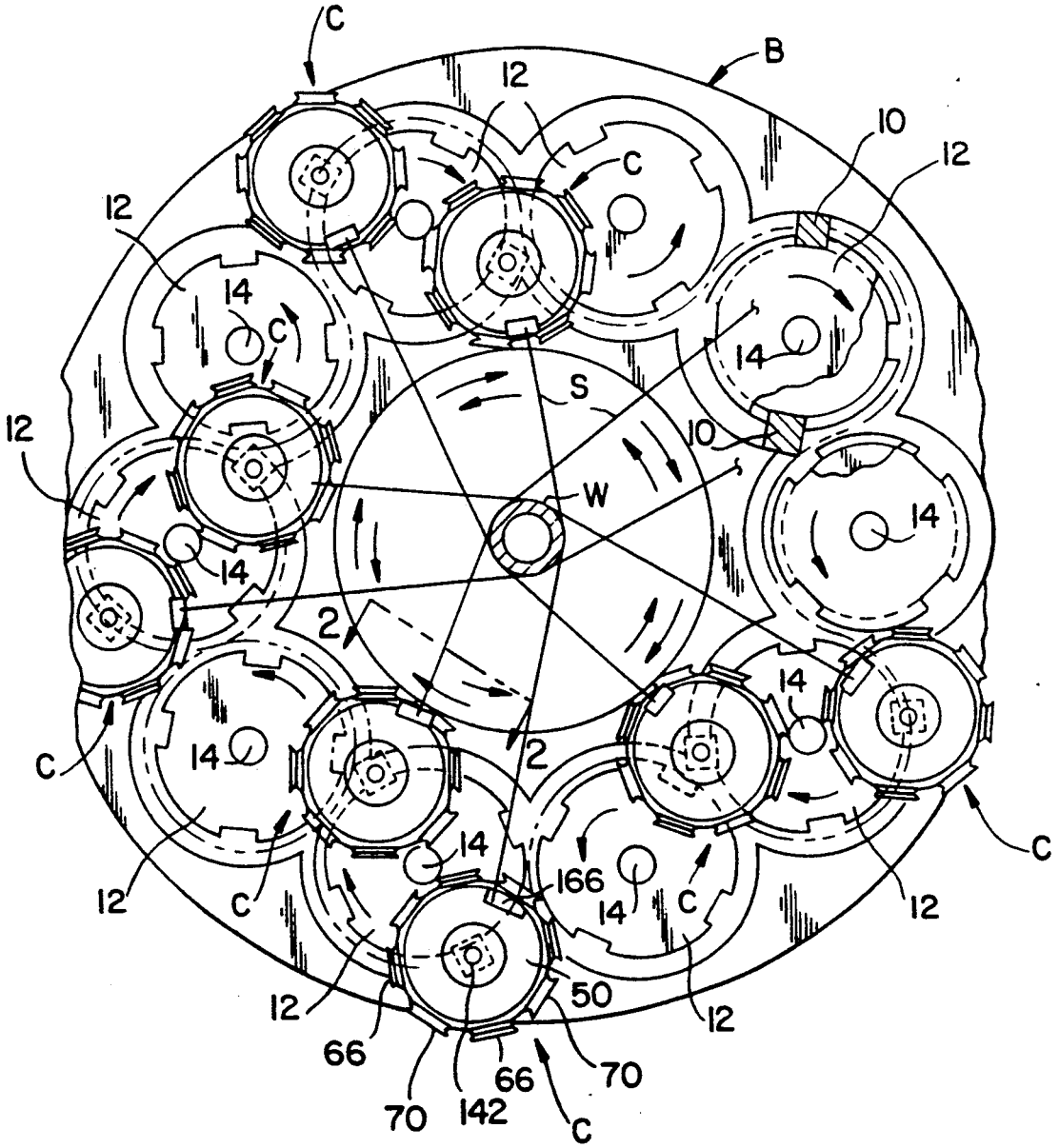
FIG. 1 is a somewhat schematic plan view of a portion of a braiding machine including strand carriers according to the present invention.

Referring now in greater detail to the drawings wherein the showings are for the purpose of illustrating preferred embodiments of the invention only and not for the purpose of limiting the invention, FIG. 1 shown in plan view a braiding machine B having a plurality of strand carriers C. Strand carries C are transported on shuttles 10 by braiding machine B in generally circumferential paths around workpiece W by notched rotors 12. Rotors 12 are disposed in a circumferential series and rotate about rotor axes 14 each in a direction opposite to an adjacent rotor. Pairs of strand carriers C are shown to be moved in opposite directions by a rotor 12 with one strand carrier C following a semi-circular path along one side of a rotor, and with another strand carrier C moving oppositely in a semi-circular path around the other side of the same rotor. Successive alternate semi-circular paths taken by each shuttle 10 around successive rotors 12 complete a revolution by the mounted strand carrier C around workpiece W, with oppositely moving strand carrier C controllably releasing strands S under tension to form a braided pattern of strands S wrapped around workpiece W. The operation of braiding machine B is known in the art and does not form a part of the present invention and, accordingly, further description thereof will be limited to the fact that the alternating semi-circular paths taken by shuttles 10 around successive adjacent rotors 12 cause shuttles 10 constantly to rotate with respect to rotor axes 14 and workpiece W, and further cause shuttles 10 to move alternately toward and away from workpiece W over a distance substantially equal to the diameter of the rotors 12.

Figure 2:
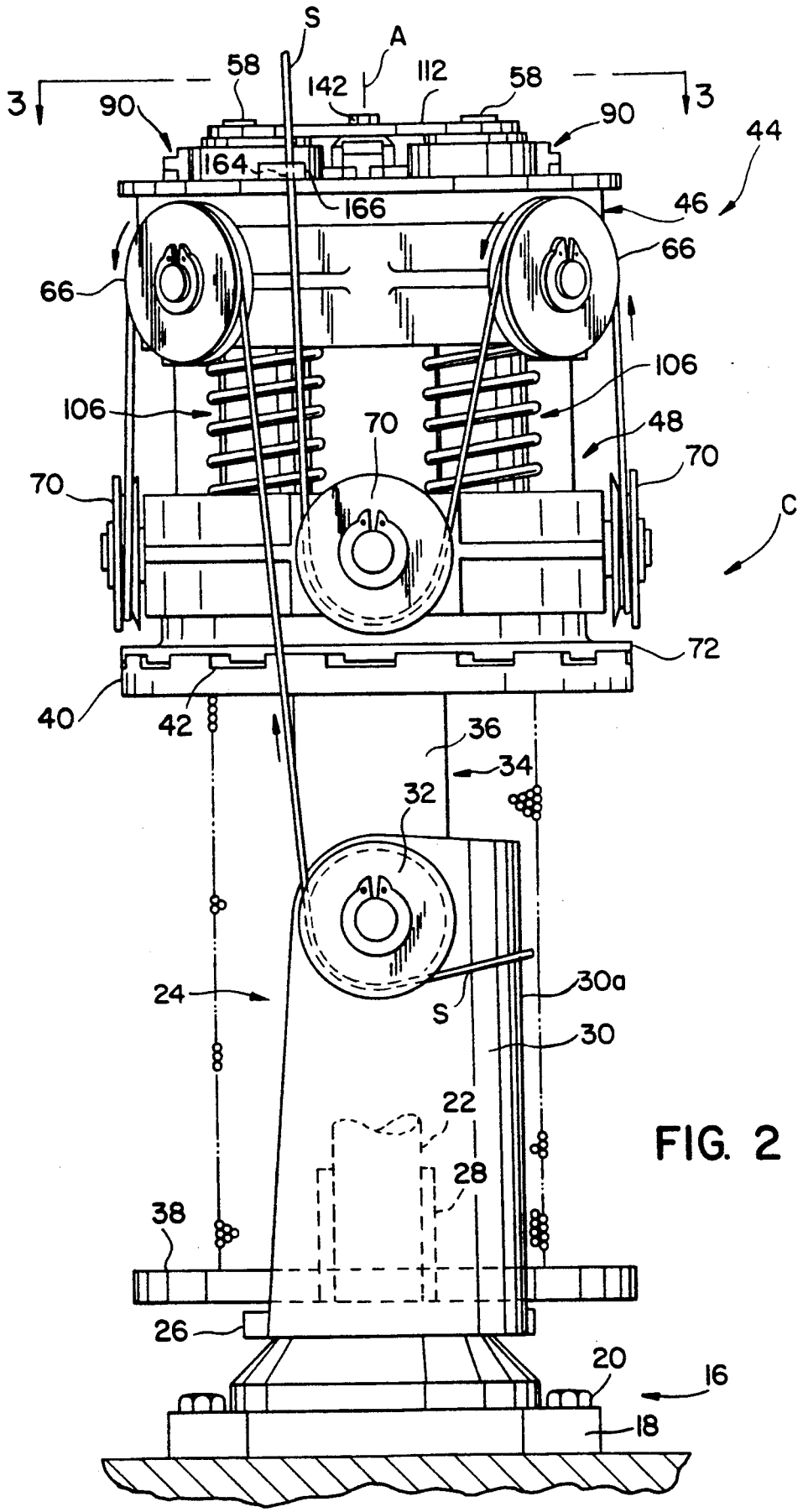
FIG. 2 is an elevation view of a strand carrier according to the present invention looking in the direction of line 2—2 in FIG. 1.
Figure 3:
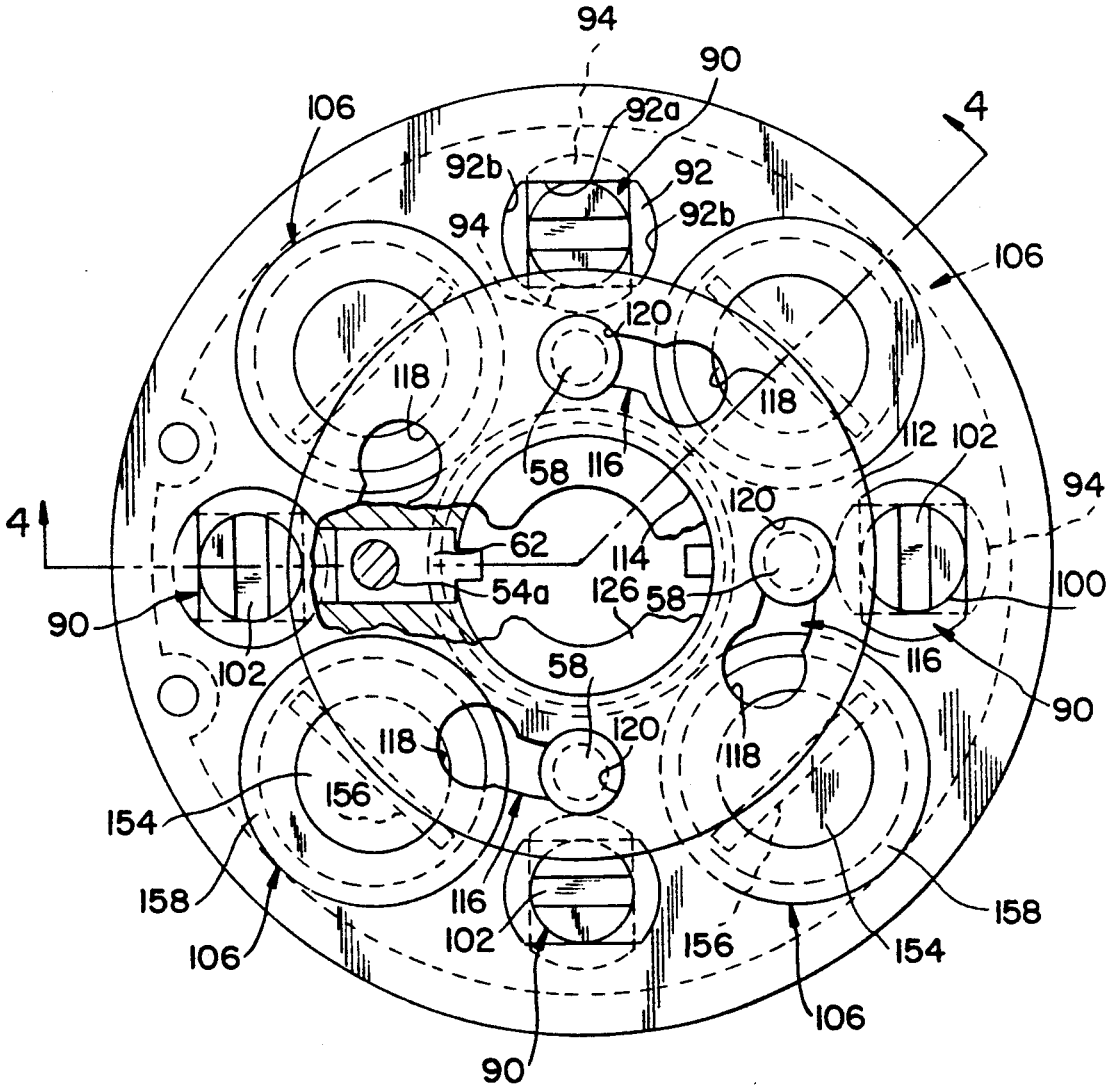
FIG. 3 is a plan view, partially in section, of the tension head removed from the support shaft and as seen in the direction of line 3—3 in FIG. 2.
Figure 4:
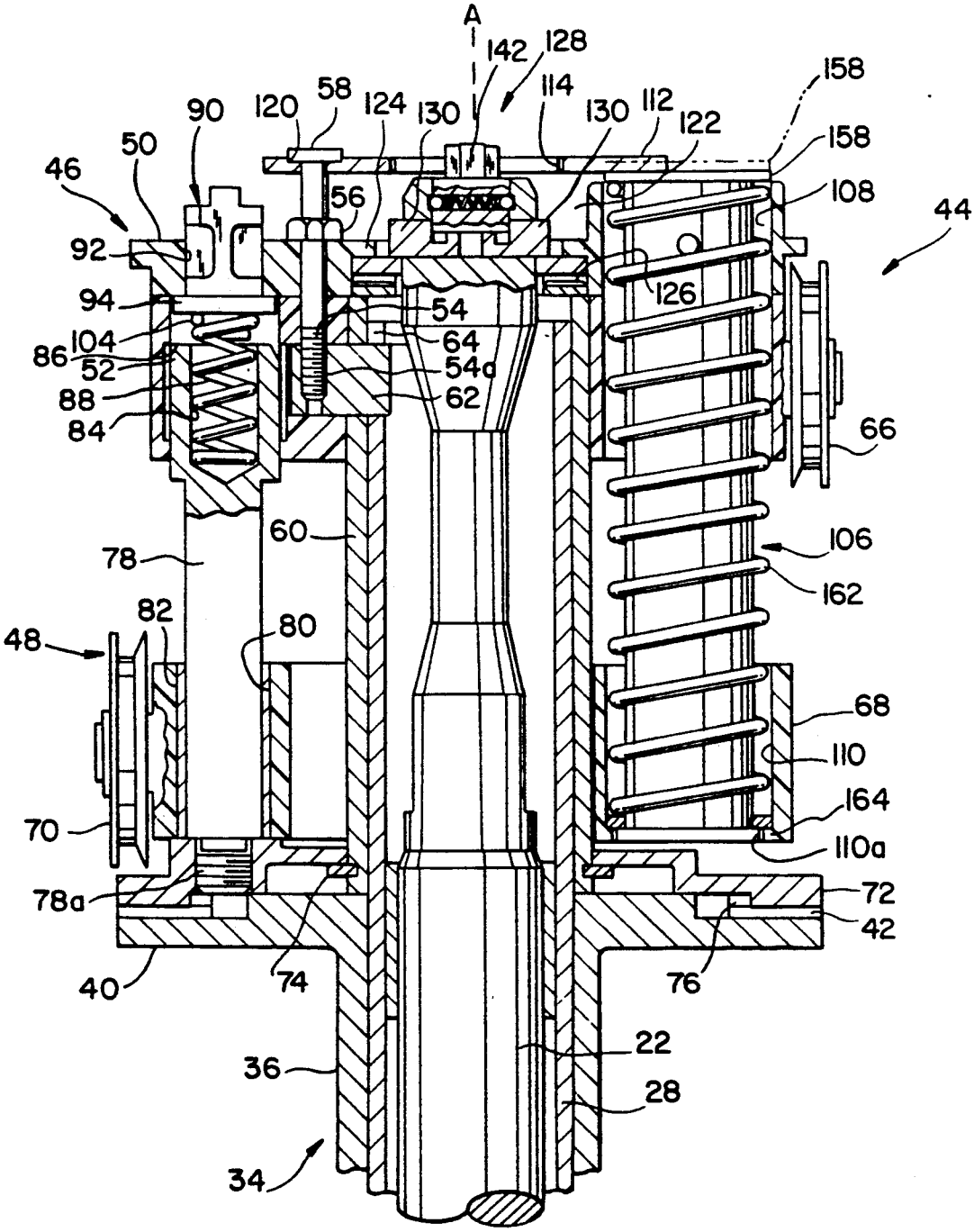
FIG. 4 is an enlarged sectional elevation view of the tension head and support shaft of the strand carrier as seen along line 4—4 in FIG. 3.

Referring now to FIGS. 2–4, stand carrier C includes a base 16 comprising a plate member 18 secured to shuttle 10 such as by bolts 20, and a spindle shaft 22 extending upwardly from plate member 18. Strand carriers usually extend horizontally from a vertical shuttle, but for the purpose of illustration herein, strand carrier C will be described with reference to a vertical axis A. Carrier C further includes a strand guide holder 24 received on spindle shaft 22 and including an apertured bottom plate 26 and an upwardly extending sleeve 28 surrounding spindle shaft 22. A plate member 30 extends upwardly from a radially outer edge of bottom plate 26 and is provided adjacent its upper end with a strand guide pulley 32. One of the circumferentially facing side edges of plate 30 is bent to extend radially inwardly to provide a flange 30*a* for slidably supporting strand S as it is played from the carrier bobbin.

The carrier bobbin, designated generally by the numerical 34, includes a tubular spool 36, a lower flange 38 and an upper flange 40. Bobbin 34 is received on shaft 22 with spool 36 in surrounding relationship with sleeve 28 of strand guide 24, and bottom flange 38 of the spool engages against bottom plate member 26 of the strand guide. The top surface of upper flange 40 is provided with circumferentially spaced apart grooves 42 for the purpose set forth hereinafter. Bobbin 34 is rotatable about axis A relative to spindle shaft 22 and sleeve 28 of strand guide 24 and is releasably restrained from rotation relative to sleeve 28 as set forth more fully hereinafter.

Carrier C further includes a tension head 44 comprised of first and second head members 46 and 48, respectively, which are coaxial with axis A and axially spaced apart therealong. Head member 46 is comprised of a pair of head plates 50 and 52 releasably secured together by a plurality of bolts 54 having bolt heads 56 and T-shaped upper ends including circular heads 58 disposed above the upper surface of head plate 50 for the purpose set forth hereinafter. Head members 46 and 48 are centrally apertured to receive a supporting sleeve 60, and head plate 52 is radially apertured to receive a pair of pins 62 which extend radially inwardly through openings therefore in sleeve 60 to axially position head member 46 on the sleeve. Pins 62 are preferably removably retained in head plate 52 by providing threaded openings therethrough to receive the threaded lower end 54*a* of the corresponding one of a pair of the bolts 54. The upper end of sleeve 28 of strand guide holder 24 is provided with diametrically opposed slots 64 axially receiving pins 62 to preclude relative rotation between tension head 44 and strand guide holder 24. Head member 46 is provided with pairs of diametrically opposed strand pulleys 66 rotatably mounted on head plate 52, and head member 48 includes a head plate 68 on which a plurality of strand pulleys 70 are rotatably mounted in diametrically opposed pairs. As will be appreciated from FIG. 2, the strand pulleys 66 and 70 are circumferentially offset by 45°.

Tension head 44 further includes an apertured clutch plate 72 received on tension head sleeve 60 and axially retained thereon by means of a split ring 74 at the lower end of sleeve 60. The bottom side of clutch plate 72 is provided with teeth 76 engaging in grooves 42 in bobbin flange 40 to restrain rotation of the bobbin relative to the tension head and thus sleeve 28 of strand guide holder 24. Clutch plate 72 is biased towards bobbin flange 40 by a plurality of clutch spring units each including a post 78 extending downwardly through an opening 80 therefor in head plate 68 and having its lower end 78*a* threadedly interengaged with an opening therefor in the clutch plate. Preferably, sleeve bearings 82 are interposed between post 78 and opening 80 to facilitate sliding movement of head plate 68 axially along posts 78. The upper end of each post 78 includes a radially enlarged upwardly open spring pocket 84 extending upwardly through an opening 86 therefor in head plate 52. Each clutch spring unit further includes a compression spring 88 which, when mounted in the tension head, is axially compressed between the inner end of pocket 84 and a removable clutch spring retainer 90 extending through an opening 92 therefor in head plate 50.

Figure 6:
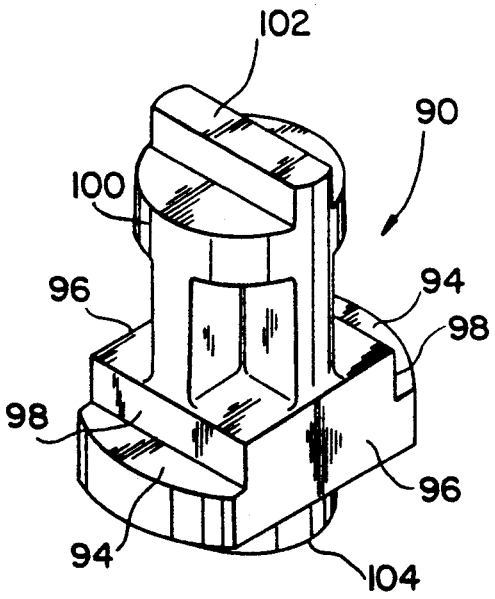
FIG. 6 is a perspective view of the clutch spring retainer.

As will be appreciated from FIGS. 3, 4 and 6, each of the openings 92 for clutch spring retainers 90 is elongate and has radially opposed parallel sides 92*a* and arcuate ends 92*b* therebetween. Spring retainer 90 has an inner end corresponding in contour to openings 92 and including arcuate tabs 94 and flat sides 96 therebetween. The inner end of retainer 90 further includes flat sides 98 axially above tabs 94 and spaced apart a distance slightly less than the distance between walls 92*a* of opening 92. The upper part 100 of retainer 90 is circular and has a diameter corresponding to the distance between sides 92*a* of opening 92 and is provided on its upper end with a tab 102 by which the retainer can be manipulated such as through the use of a pair of pliers. The bottom of the retainer is provided with a circular projection 104 received in the corresponding compression spring 88. Each retainer 90 is adapted to compress and hold the corresponding clutch spring in the position shown in FIG. 4 by inserting the lower end of the retainer into opening 92 and pushing the retainer axially inwardly a distance sufficient for flat sides 96 and 98 to clear the bottom of head plate 50. By then turning the retainer 90°, tabs 94 extend radially of opening 92 and underlie the bottom surface of head plate 50. The retainer is then released and compression spring 88 biases the retainer upwardly whereupon flat sides 98 and the corresponding portions of flat sides 96 re-enter the lower end of opening 90. In this position, the sides preclude rotation of the retainer and tabs 94 engage the underside of head plate 50 to hold the retainer against axial separation from head 46.

Tension head 44 further includes a plurality of tension spring cartridges 106 between head members 46 and 48 and which serve to bias head member 48 away from head member 46 and into engagement with the upper side of clutch plate 72. Each spring cartridge 106 extends through a corresponding opening 108 therefor in head member 46 and into an upwardly open pocket 110 in head plate 68, the bottom of which pocket 110 is provided with an opening 110*a* for the purpose which will become apparent hereinafter. Further, tension spring cartridges 106 are preferably removably retained between head members 46 and 48 by a common retaining plate 112 which is releasably interengaged with round heads 58 on the outer ends of bolts 54. More particularly in this respect, as best seen in FIGS. 3 and 4, retaining plate 112 is provided with a central opening 114 to provide access to the upper end of shaft 22, for the purpose set forth more fully hereinafter, and is provided with keyhole slits 116 in diametrically opposed pairs equally spaced apart thereabout. Keyhole slots 116 include a circular opening 118 at one end thereof of a diameter to permit circular heads 58 to pass therethrough, and the slot is of a width between the opposite ends thereof slightly larger than the diameter of the shank portion of bolt 54 between heads 56 and 58. The opposite ends of the keyhole slots are provided with shallow recesses 120 having a diameter corresponding to that of heads 58, whereby it will be appreciated that retainer plate 112 is adapted to be introduced onto heads 58 and rotated about axis A to position the heads over recesses 120. As will be described, spring cartridges 106 extend axially outwardly of openings 108 and thus bias plate 112 axially outwardly for heads 58 to enter recesses 120, whereby unintended rotation of retainer 112 and release of the cartridges is precluded.

Figure 5:
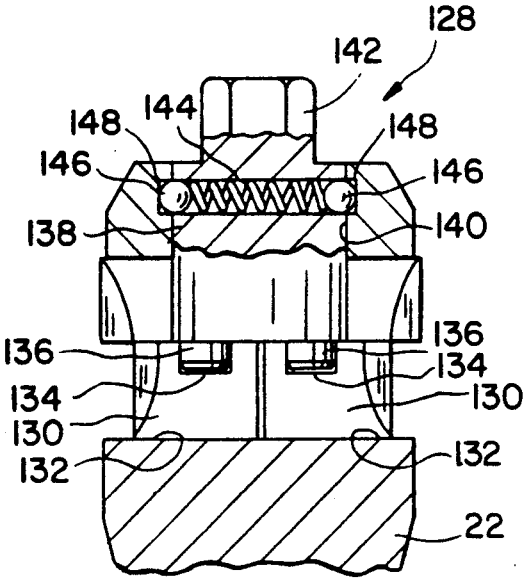
FIG. 5 is a sectional elevation view of the latch assembly between the tension head and shaft.

Head plate 50 includes a central opening 112 receiving the upper end of spindle shaft 22 and a radially inwardly extending peripheral flange 124 in opening 122. A thrust bearing assembly 126 is interposed between flange 124 and the upper end of tension head sleeve 60, and the tension head assembly is releasably mounted on spindle shaft 22 by a latch mechanism 128 in the upper end of the spindle shaft. As will be appreciated from FIGS. 4 and 5 of the drawing, latch assembly 128 includes a pair of latch elements 130 radially slidably supported in diametrically opposed bores 132 in shaft 22 and having radially inner ends provided with upwardly open slots 134 each receiving a corresponding one of a pair of pins 136 extending downwardly from a latch actuator 138 rotatably received in bore 140 in shaft 22. The axially outer end of actuator 138 is provided with a hexagonal head 142 by which the actuator is rotated. The actuator is provided with a diametrical bore receiving a spring 144 and detent balls 146, and corresponding ball recesses 148 are provided in bore 140 to axially retain the component parts of the latch assembly and to hold the latch elements 130 in their operative positions. With regard to FIG. 5, it will be appreciated that pins 136 are circumferentially offset relative to the plane of the figure, whereby rotation of actuator 138 in one direction displaces pins 136 relative to slots 134 such that latch elements 130 are displaced radially outwardly of bores 132 to the extended positions shown in FIG. 4. Rotation of actuator 138 in the opposite direction displaces latch elements radially inwardly to their retracted positions shown in FIG. 5. It will be further appreciated that, while not shown, bore 140 is provided with ball detent openings 148 corresponding to those shown in FIG. 5 and in the position of actuator 138 corresponding to the radially outer positions of latch elements 130. When latch elements 130 are in the extended positions shown in FIG. 4, the radially outer ends thereof overlying the upper side of thrust bearing assembly 126, thus precluding axial separation o tension head 44 from the spindle shaft. Rotation of actuator 138 through head 142 about 30° displaces latch elements 130 to the radially inner positions thereof, whereby the latch elements disengage thrust bearing assembly 126 releasing tension head assembly 44 for axial separation from sleeve 28 of strand guide holder 24 and thus spindle shaft 22.

Figure 7:
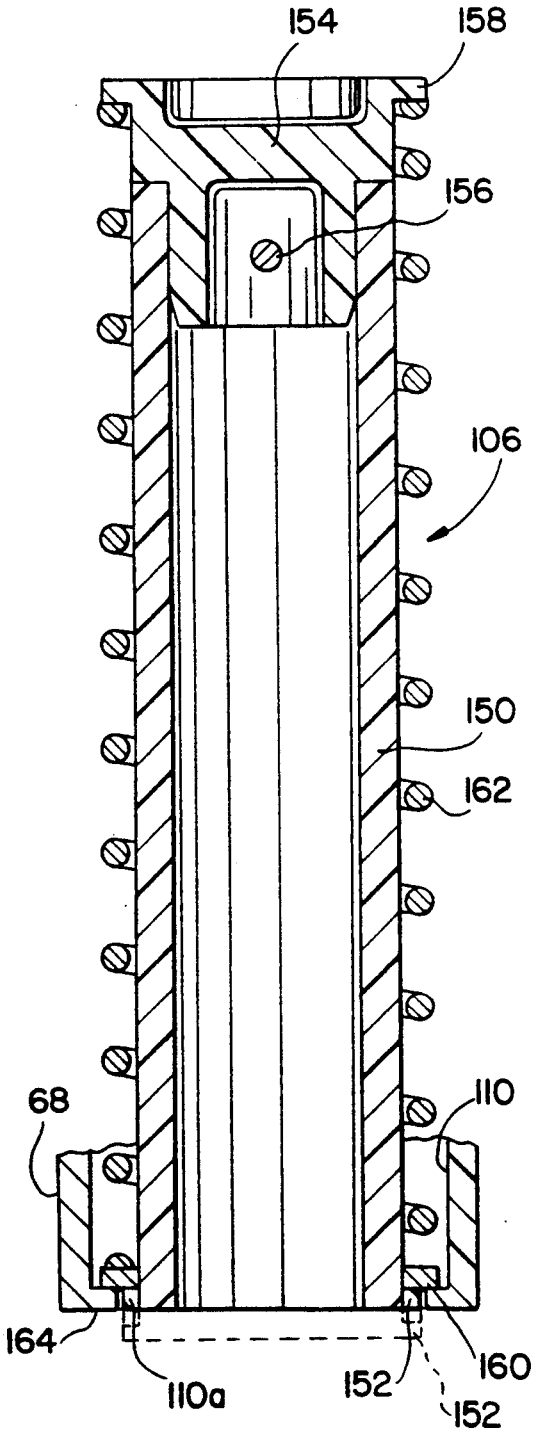
FIG. 7 is a sectional elevation view of a tension spring cartridge in accordance with the present invention.

In accordance with the present invention, tension spring cartridges 106 are adapted to be inserted and removed from tension head 44 with the tension spring maintained in a precompressed condition, whereby such insertion and removal as well as assembly and disassembly of the component parts of the tension head can be achieved more quickly and safely than heretofore possible. A preferred embodiment of the tension spring cartridge for this purpose is illustrated in FIG. 7 of the drawing. In this respect, the spring cartridge includes a tubular spring support and guide component 150 having a radially outwardly extending flange 152 at one thereof and a removable spring retaining plug 154 secured to the other end thereof such as by a diametrically extending pin 156 extending through the plug and tubular member 150. Plug 154 has a radially outwardly extending flange 158, and an annular, floating collar 160 is axially slidably received on tubular member 150 and is axially retained thereon by abutment with flange 152. Tension controlling compression spring 162 surrounds tubular support 150 and is axially compressed between flange 158 and collar 160. Spring 162 has an uncompressed length of twenty or more inches and a compressed length of about four inches providing a spring force in the compressed condition of from ten to forty pounds. When spring cartridge retaining plate 112 is removed from head member 46, spring cartridges 106 are adapted to be axially introduced downwardly through openings 108 in head member 46 for the lower ends of the cartridges to enter the corresponding one of the spring pockets 110 in head member 48. Openings **110*a* in the bottoms of pockets 110 are of a diameter greater than the diameter of flange 152 of the spring cartridge support and less than the diameter of collar 160. The lower ends of pockets 110 are provided with a radially inwardly extending peripheral flange 164 surrounding opening 110*a* and underlying collar 160. Preferably, when cartridges 106 are introduced into openings 108 and pockets 110 for collars 160 to engage flanges 164, flanges 158 at the upper ends of the cartridges extend above the upper surface of head plate 50 to the broken line position shown in FIG. 4. After cartridge spring retaining plate 112 is in its assembled position shown in FIG. 4, upper flange 158 of the cartridge is in the solid line position shown in FIG. 4 and lower flange 152 is in the broken line position shown therefor in FIG. 7. This advantageously provides for spring 162 to be further slightly compressed when cartridge retaining plate 112 is assembled with heads 58 of bolts 54 as described hereinabove, thus to bias the retaining plate axially outwardly so that heads 58 are seated in recesses 120 to preclude unintentional release of the retaining plate form heads 58 and, further, to axially bias head members 46 and 48** away from one another to eliminate any free play therebetween.

Strand S is wound on spool 36 of bobbin 34 and extends therefrom across guide flange **30*a* and thence around lower strand guide pulley 32 and upwardly toward tension head 44. Strand S then extends through the tension head alternately between upper and lower strand pulleys 66 and 70 thereon and, finally, extends away from strand carrier C through an opening 164 in an upper strand guide 166 mounted on tension head member 46 between a pair of the strand guide pulleys 66** thereon.

It is believed that the operation of the strand carrier will be obvious from the foregoing description and from my aforementioned U.S. Pat. No. 4,719,838. Briefly in this respect, bobbin 34 is constrained from rotation about sleeve 28 of lower strand guide holder 24, and thus tension head 44, by the interengagement between clutch plate 76 and bobbin flange 40, whereby the tension head, bobbin and lower strand guide holder 24 are adapted to rotate as a unit relative to spindle shaft 22. With bobbin 34 so constrained, strand S cannot unwind therefrom and, as carrier C moves radially away from workpiece W during operation of the braiding machine, the strand between pulleys 66 and 70 causes lower tension head member 48 to move axially toward upper head member 46 along sleeve 60 and against the bias resulting from further compression of springs 162 of spring cartridges 106. Eventually, the upper surface of tension head member 48 engages the undersides of clutch spring pockets 84 and lifts posts 78 and thus clutch plate 72 upwardly against the biasing force of clutch springs 88. The lifting of clutch plate 72 disengages teeth 76 thereon from recesses 42 in bobbin flange 40, whereby the bobbin is free to rotate relative to the tension head about sleeve 28 of lower strand guide holder 24 to allow strand S to unwind from the bobbin. As carrier C moves radially toward workpiece W, a certain amount of slack is produced in strand S. This slack is taken up in that springs 162 in tension spring cartridges 106 force lower tension head member 48 away from upper head member 46 to increase the length of strand between the strand guide pulleys thereon. Further, as lower tension head member 48 moves away from upper member 46 and disengages from the undersides of clutch spring pockets 84, clutch plate 72 reengages with bobbin flange 40 to again constrain rotation of the bobbin relative to the tension head and lower strand guide holder.

It will be appreciated that disassembly of the major component parts of carrier C is readily achieved simply by rotating actuator 142 at the upper end of spindle shaft 22 to disengage latch members 130 from the upper end if thrust bearing assembly 126. Tension head 44 is then axially removed upwardly through slots 64 in sleeve 28, after which bobbin 34 can be removed and replaced with a replenished supply of strand. If further disassembly is desired, it will be appreciated that lower strand guide carrier 24 is readily removed axially from spindle shaft 22. It will likewise be appreciated that reassembly of the foregoing component parts is readily achieved and that, when assembled relative to shaft 22, locking of the component parts on the shaft merely requires turning of actuator 142 to re-engage latch members 130 with thrust bearing assembly 126. With or without the latter disassembly of tension head 44 from sleeve 28, it will be appreciated that the outer periphery of tension spring cartridge retaining plate 112 is radially inwardly adjacent clutch spring retainer plugs 90, whereby the latter and clutch springs 88 are accessible for removal from tension head 44 independent of any other disassembly operation. Likewise, tension spring cartridges 106 are accessible for removal from tension head 44 independent of any other disassembly operation other than removal of retaining plate 112.

When it is desired to disassemble the component parts of tension head 44, the latter is quickly achieved by removing the clutch springs and tension head spring cartridges as described hereinabove, and then at least partially removing the two bolts 54 engaging pins 62 so that the latter can be withdrawn radially inwardly of tension head support sleeve 60 to release upper head member 46 for removal from sleeve 60. Lower head member 48 and clutch plate 72 are then readily axially separable from sleeve 60. Importantly, in accordance with the present invention, the latter disassembly and thus reassembly of the component parts of tension head 44 can be both quickly and safely achieved in that spring cartridges 106 preclude having to release the compressed force of tension head springs 162.

While it is preferred to construct the tension head spring cartridges as shown in FIG. 7 and described hereinabove, and while it is preferred to mount the spring cartridges between the tension head members as shown in FIG. 4 through the use of retaining plate 112, it will be appreciated that a number of other spring cartridge arrangements can be devised which would be operable as described hereinabove, and that other arrangements for mounting such spring cartridges, including cartridge 106 illustrated in FIG. 7, can likewise be devised. For example, it will be appreciated that cartridges 106 illustrated om FIG. 7 could be individually axially retained between head members 46 and 48 by providing the upper ends of openings 108 in head member 46 with a circumferential recess to receive a split retaining ring which would radially overlie flange 158 on the upper end of support member 150 of spring cartridge 106. Still further, the spring cartridge support could be of axially telescoping construction with the telescoping members having interengaging components to limit the axial length thereof with the spring mounted thereon in compressed condition. In such an arrangement the compression spring could be disposed either internally or externally of the support. Such a spring cartridge construction would enable the spring cartridge to be disposed between axially opposed, closed bottom pockets in the upper and lower tension head members, or a closed bottom pocket in lower member 48 together with a spring cartridge retaining arrangement on upper tension head member 46 as shown in FIG. 4. These and other modifications of the preferred spring cartridge and cartridge retaining arrangement, as well as other embodiments of the spring cartridge and retention thereof will be obvious and suggested to those skilled in the art. Likewise, other modifications of the component parts of the tension head and the latch arrangement for the carrier components will be suggested or obvious to those skilled in the art from the disclosure herein. Accordingly, it is to be distinctly understood that the foregoing descriptive matter is to be interpreted merely as illustrative of the present invention and not as a limitation thereof.

Having thus described the invention, it is claimed:

1. In a strand carrier for carrying and releasing a strand withdrawn therefrom under tension in a braiding machine, said carrier including a support shaft having an axis, a strand supply bobbin, and a tension head for tensioning a strand withdrawn from said bobbin, said bobbin and said tension head being coaxial with and axially slidably received on said shaft, said shaft having an axially outer end, and said tension head having an end adjacent said outer end of said shaft, the improvement comprising: said shaft including latch means mounted and axially fixed thereon and displaceable relative thereto between latching and unlatching positions relative to said tension head, latch actuator means mounted on said shaft for displacing said latch means between said latching and unlatching positions, said latch means engaging said tension head in said latching position to releasably retain said tension head and said bobbin on said shaft.

2. A strand carrier according to claim 1, wherein said latch means includes latch element means supported on said shaft for displacement radially thereof between extended and retracted positions corresponding respectively to said latched and unlatched positions.

3. A strand carrier according to claim 2, wherein said latch actuator means includes latch element actuator means at said outer end of said shaft.

4. In a strand carrier for carrying and releasing a strand withdrawn therefrom under tension in a braiding machine, said carrier including a support shaft having an axis, a strand supply bobbin, and a tension head for tensioning a strand withdrawn from said bobbin, said bobbin and said tension head being coaxial with and axially slidably received on said shaft, said shaft having an axially outer end, and said tension head having an end adjacent said outer end of said shaft, the improvement comprising: said shaft including latch means mounted thereon and displaceable relative thereto between latching and unlatching positions relative to said tension head, latch actuator means mounted on said shaft for displacing said latch means between said latching and unlatching positions, said latch means in said latching position engaging said tension head to releasably retain said tension head and said bobbin on said shaft, said latch means including latch element means supported on said shaft for displacement radially thereof between extended and retracted positions corresponding respectively to said latched and unlatched positions, said latch actuator means including latch element actuator means at said outer end of said shaft, said latch element means including a pair of latch elements radially slidably supported in a diametrical bore therefor in said shaft, said latch elements having radially inner ends in said bore, said latch element actuator means being supported for rotation in an axial bore in said outer end of said shaft opening into said diametrical bore, said actuator means having an axially inner end, and said inner ends of said actuator means and said latch elements having means interengaging to extend and retract said latch elements in response to rotation of said actuator means.

5. A strand carrier according to claim 4, wherein said means interengaging said inner end of said actuator means and said latch elements includes pins on said inner end of said actuator means and slots in said inner ends of said latch elements.

* * * * *